US008851618B2

(12) United States Patent
Teshigawara et al.

(10) Patent No.: US 8,851,618 B2
(45) Date of Patent: Oct. 7, 2014

(54) INKJET PRINTING APPARATUS AND INKJET PRINTING METHOD

(71) Applicant: Canon Kabushiki Kaisha, Tokyo (JP)

(72) Inventors: Minoru Teshigawara, Saitama (JP); Yoshiaki Murayama, Tokyo (JP); Susumu Hirosawa, Tokyo (JP); Takatoshi Nakano, Yokohama (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/932,329

(22) Filed: Jul. 1, 2013

(65) Prior Publication Data

US 2014/0009529 A1 Jan. 9, 2014

(30) Foreign Application Priority Data

Jul. 4, 2012 (JP) ..... 2012-150636

(51) Int. Cl.

| | |
|---|---|
| ***B41J 29/393*** | (2006.01) |
| ***B41J 2/015*** | (2006.01) |
| ***B41J 2/165*** | (2006.01) |
| ***B41J 2/21*** | (2006.01) |

(52) U.S. Cl.

CPC ..... *B41J 2/16517* (2013.01); *B41J 2/2146* (2013.01); *B41J 2002/16573* (2013.01)

USPC ..... 347/19; 347/20; 347/21; 347/22; 347/23

(58) Field of Classification Search

USPC ..... 347/19–23, 47

See application file for complete search history.

(56) References Cited

U.S. PATENT DOCUMENTS

| | | | | |
|---|---|---|---|---|
| 2009/0085952 | A1* | 4/2009 | Yamazaki | 347/19 |
| 2010/0303281 | A1* | 12/2010 | Wu et al. | 382/100 |
| 2011/0227988 | A1* | 9/2011 | Yamazaki | 347/19 |

FOREIGN PATENT DOCUMENTS

JP 2012-71568 A 4/2012

* cited by examiner

*Primary Examiner* — Jason Uhlenhake

(74) *Attorney, Agent, or Firm* — Fitzpatrick, Cella, Harper & Scinto

(57) ABSTRACT

An ejection complement process is performed during which both a usual ejection failure and a sudden ejection failure can be appropriately coped with, without being accompanied by a frequent maintenance process. In a case wherein sequential printing is not currently being performed, the first detection process is performed with a high accuracy while being accompanied by the maintenance process, and in a case wherein sequential printing is currently being performed, the second detection process that requires only a small process load is performed at a predetermined timing without being accompanied by the maintenance processing. At this time, when the number of ejection failed nozzles detected in the second ejection process has reached a predetermined value or greater, the maintenance process is performed, and only the information for the ejection failed nozzle, detected in the second detection process, is reset.

14 Claims, 15 Drawing Sheets

| | NOZZLE ARRAY | | | |
|---|---|---|---|---|
| | 14 | 13 | 12 | 11 |
| 1 | 0 | 0 | 0 | 0 |
| 2 | 0 | 0 | 0 | 0 |
| 3 | 0 | 0 | 0 | 0 |
| 4 | 1 | 0 | 0 | 0 |
| 5 | 0 | 0 | 0 | 0 |
| 6 | 0 | 0 | 0 | 0 |
| 7 | 0 | 0 | 0 | 0 |
| 8 | 0 | 0 | 0 | 0 |
| 9 | 0 | 0 | 0 | 0 |
| 10 | 0 | 0 | 0 | 0 |
| 11 | 0 | 0 | 0 | 0 |
| 12 | 0 | 0 | 0 | 0 |

| | NOZZLE ARRAY | | | |
|---|---|---|---|---|
| | 14 | 13 | 12 | 11 |
| 1 | 0 | 0 | 0 | 0 |
| 2 | 0 | 0 | 0 | 0 |
| 3 | 0 | 0 | 0 | 0 |
| 4 | 1 | 0 | 0 | 0 |
| 5 | 0 | 0 | 0 | 0 |
| 6 | 0 | 0 | 0 | 0 |
| 7 | 0 | 0 | 0 | 0 |
| 8 | 0 | 0 | 0 | 0 |
| 9 | 0 | 0 | 0 | 0 |
| 10 | 0 | 0 | 0 | 0 |
| 11 | 0 | 0 | 0 | 0 |
| 12 | 0 | 0 | 0 | 0 |

| | NOZZLE ARRAY | | | |
|---|---|---|---|---|
| | 14 | 13 | 12 | 11 |
| 1 | 0 | 0 | 0 | 0 |
| 2 | 0 | 0 | 0 | 0 |
| 3 | 0 | 0 | 0 | 0 |
| 4 | 0 | 0 | 0 | 0 |
| 5 | 0 | 0 | 0 | 0 |
| 6 | 0 | 0 | 1 | 0 |
| 7 | 0 | 0 | 0 | 0 |
| 8 | 0 | 0 | 0 | 0 |
| 9 | 0 | 0 | 0 | 0 |
| 10 | 0 | 0 | 0 | 0 |
| 11 | 0 | 0 | 0 | 0 |
| 12 | 0 | 0 | 0 | 0 |

| | NOZZLE ARRAY | | | |
|---|---|---|---|---|
| | 14 | 13 | 12 | 11 |
| 1 | 0 | 0 | 0 | 0 |
| 2 | 0 | 0 | 0 | 0 |
| 3 | 0 | 0 | 1 | 0 |
| 4 | 0 | 0 | 1 | 0 |
| 5 | 0 | 0 | 1 | 0 |
| 6 | 0 | 0 | 1 | 0 |
| 7 | 0 | 0 | 1 | 0 |
| 8 | 0 | 0 | 1 | 0 |
| 9 | 0 | 0 | 0 | 0 |
| 10 | 0 | 0 | 0 | 0 |
| 11 | 0 | 0 | 0 | 0 |
| 12 | 0 | 0 | 0 | 0 |

INKJET PRINTING APPARATUS AND INKJET PRINTING METHOD

BACKGROUND OF THE INVENTION

1. Field of the Invention

The present invention relates to an inkjet printing apparatus and an inkjet printing method. In particular, the present invention relates to an ejection failure complementary printing method for detecting a printing element where an ejection failure has occurred, and for employing another printing element to complement data to be printed by the defective ejection printing element.

2. Description of the Related Art

An inkjet printing apparatus employs a print head that includes multiple nozzles for the ejection of ink droplets, and during printing, there is a possibility that an ejection failure could suddenly occur at these nozzles, without warning, and cause a printed image to be disfigured by striping and/or variations in printing ink densities. In the event, the main cause of such an ejection failure is the presence of a foreign substance near the nozzles, or the entry of bubbles into the nozzles, and in most cases, such an ejection failure can be corrected for by performing a print head maintenance process. However, in a case wherein continuous paper is being employed for printing, or wherein cut sheet paper is being employed to perform sequential printing, maintaining of a high-speed output capability is important, and therefore, during printing, it is impractical for a maintenance process, which requires a comparatively great deal of time, to be performed frequently.

In such a case, when a so-called ejection failure complement process can be employed, during which printing is performed while print data to be printed by a nozzle whereat an ejection failure has occurred is complemented by using another nozzle, an obstacle, such as stripes and/or density unevenness, does not appear in a printed image, even without a maintenance process being performed. Further, the ejection failure complement process is also effective for an ejection failure that is caused by a heater breakdown or the clogging of nozzles that can not be corrected for by performing the normal maintenance process.

In Japanese Patent Laid-Open No. 2012-71568, an inkjet printing method is disclosed that can perform both a first ejection failure complement process with a comparatively high accuracy, for detecting and correcting the ejection state before the printing operation is performed, and a second ejection failure complement process with a comparatively high processing speed, for detecting and correcting the ejection state during the printing operation. When the ejection failure complement process is prepared in two stages, both a commonly occurring ejection failure and a sudden ejection failure can be appropriately coped with, and an image without stripes and uneven densities can be stably output.

During the ejection failure complement process, information for a nozzle that has been detected as being an ejection failed nozzle is stored in a specific storage unit, and, based on the information, print data for the ejection failed nozzle is allocated for other normal nozzles. Therefore, when printing is performed for an extended period of time while the second ejection failure complement process is being employed, there is a case wherein the number of nozzles that are found to have had an ejection failure has increased more and more, and the printing performed for the nozzles identified as having had an ejection failure can not be complemented by employing normally available nozzles. Further, since the ejection frequencies of the remaining normal nozzles are increased continuously, the service lives of these nozzles may be reduced. Meanwhile, in a case wherein there is a sudden ejection failure, what often happens is that the failed nozzle recovers naturally, during the printing operation, without the maintenance process being performed, and in such a case, when the determination results for the ejection failed nozzle are not updated for a long time, the possibility that the nozzle rejoins the others as a normal nozzle will be lost. Therefore, it is desirable that information for a nozzle that is detected as an ejection failed nozzle be reset at an appropriate timing.

However, in the ejection failure complement process described in Japanese Patent Laid-Open No. 2012-71568, ejection failure information detected both in the first ejection failure complement process and ejection failure information detected in the second ejection failure complement process are stored together, and the total of the two sets of information are employed for the process. Therefore, when information for an ejection failure that suddenly occurred during the printing operation is reset, information for the usual ejection failure that is identified before the printing operation is also cleared, and an image obstacle, such as stripes or density unevenness's, would appear in an image that is printed immediately after the resetting of information has been performed.

SUMMARY OF THE INVENTION

The present invention is provided to resolve the above described problem. One objective of the present invention is to perform an ejection failure complement process wherein both a first ejection failure complement process with high accuracy and a second ejection failure complement process with a high processing speed are employed, and both a usual ejection failure and a sudden ejection failure can be appropriately coped with, while frequent performance of a maintenance process is not required.

In a first aspect of the present invention, there is provided an inkjet printing apparatus, which employs a print head wherein a plurality of nozzles for ejecting ink are arranged in a predetermined direction, and sequentially prints a plurality of images on a printing medium that is conveyed in a direction that intersects the predetermined direction, comprising: a maintenance unit configured to perform maintenance for the print head; a determination unit configured to perform a first determination, in which whether a nozzle is an ejection failed nozzle or not is determined based on a result obtained by scanning a first detection pattern during a period other than a sequential printing operation, and a second determination, in which whether a nozzle is an ejection failed nozzle or not is determined based on a result obtained by scanning a second detection pattern during the sequential printing operation; a storage unit configured to store first information, which corresponds to results obtained by the first determination, and second information that corresponds to results obtained by the second determination; a printing unit configured to employ a nozzle wherein an ejection failure has not occurred, and not employ an ejection failed nozzle, based on the first information and the second information, and perform the sequential printing, of the plurality of images on the printing medium; and a changing unit configured to maintain, in a case wherein the first determination is not performed after the maintenance by the maintenance unit has been performed, the first information unchanged, and change the second information from information indicating an ejection failed nozzle to information indicating a nozzle whereat an ejection failure has not occurred.

In a second aspect of the present invention, there is provided an inkjet printing method, for employing a print head wherein a plurality of nozzles for ejecting ink are arranged in a predetermined direction, and sequentially printing a plurality of images on a printing medium that is conveyed in a direction that intersects the predetermined direction, comprising: a maintenance step of performing maintenance for the print head; a determination step of performing a first determination, in which whether a nozzle is an ejection failed nozzle or not is determined based on a result obtained by scanning a first detection pattern during a period other than a sequential printing operation, and a second determination, in which whether a nozzle is an ejection failed nozzle or not is determined based on a result obtained by scanning a second detection pattern during the sequential printing operation; a storage step of storing first information, which corresponds to results obtained by the first determination, and second information that corresponds to results obtained by the second determination; a printing step of employing a nozzle wherein an ejection failure has not occurred, and not employing an ejection failed nozzle, based on the first information and the second information, and performing the sequential printing, of the plurality of images on the printing medium; and a changing step of maintaining, in a case wherein the first determination is not performed after the maintenance by the maintenance unit has been performed, the first information, unchanged, and changing the second information from information indicating an ejection failed nozzle to information indicating a nozzle whereat an ejection failure has not occurred.

Further features of the present invention will become apparent from the following description of exemplary embodiments (with reference to the attached drawings).

DESCRIPTION OF THE EMBODIMENT

Figure 1:
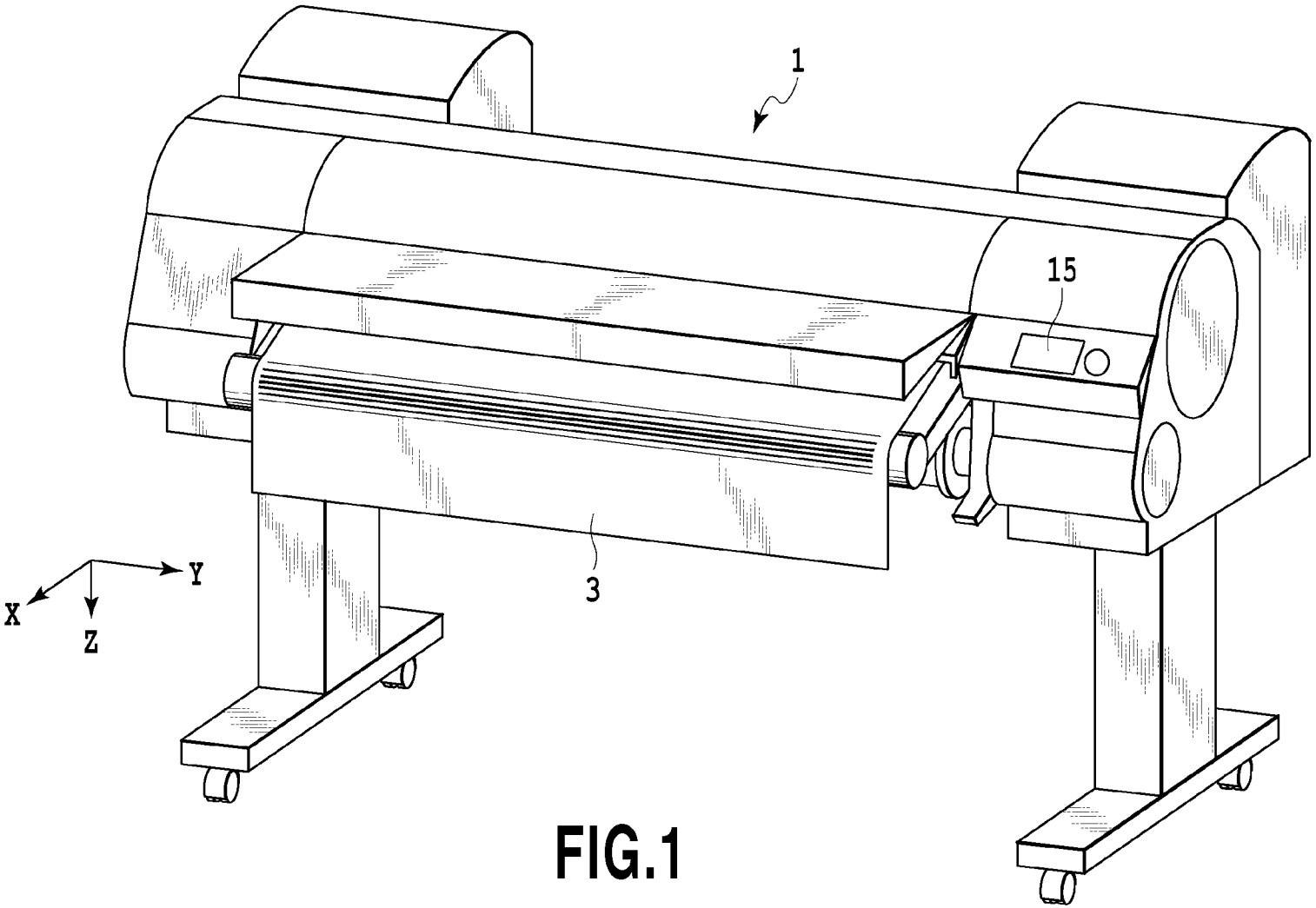
FIG. 1 is a diagram illustrating the external appearance of an inkjet printing apparatus that can be applied for the present invention.

The embodiment of the present invention will now be described in detail while referring to the drawings.

First Embodiment

FIG. 1 is a diagram illustrating the external appearance of an inkjet printing apparatus 1 (hereinafter referred to as a "printing apparatus 1") according to a first embodiment of the present invention. A printing medium 3, which is supported in a rolled shape by the printing apparatus 1, is fed to a printing unit 5 that will be described later, and based on print data, printing of the printing medium 3 is performed. After the printing has been completed, the printing medium 3 is extracted in a direction X, as shown in FIG. 1. A user employs various switches provided on an operating unit 15 to enter, for the printing apparatus 1, various commands, such as a size designation for the printing medium 3 and for switching performed between on line/off line.

Figure 2:
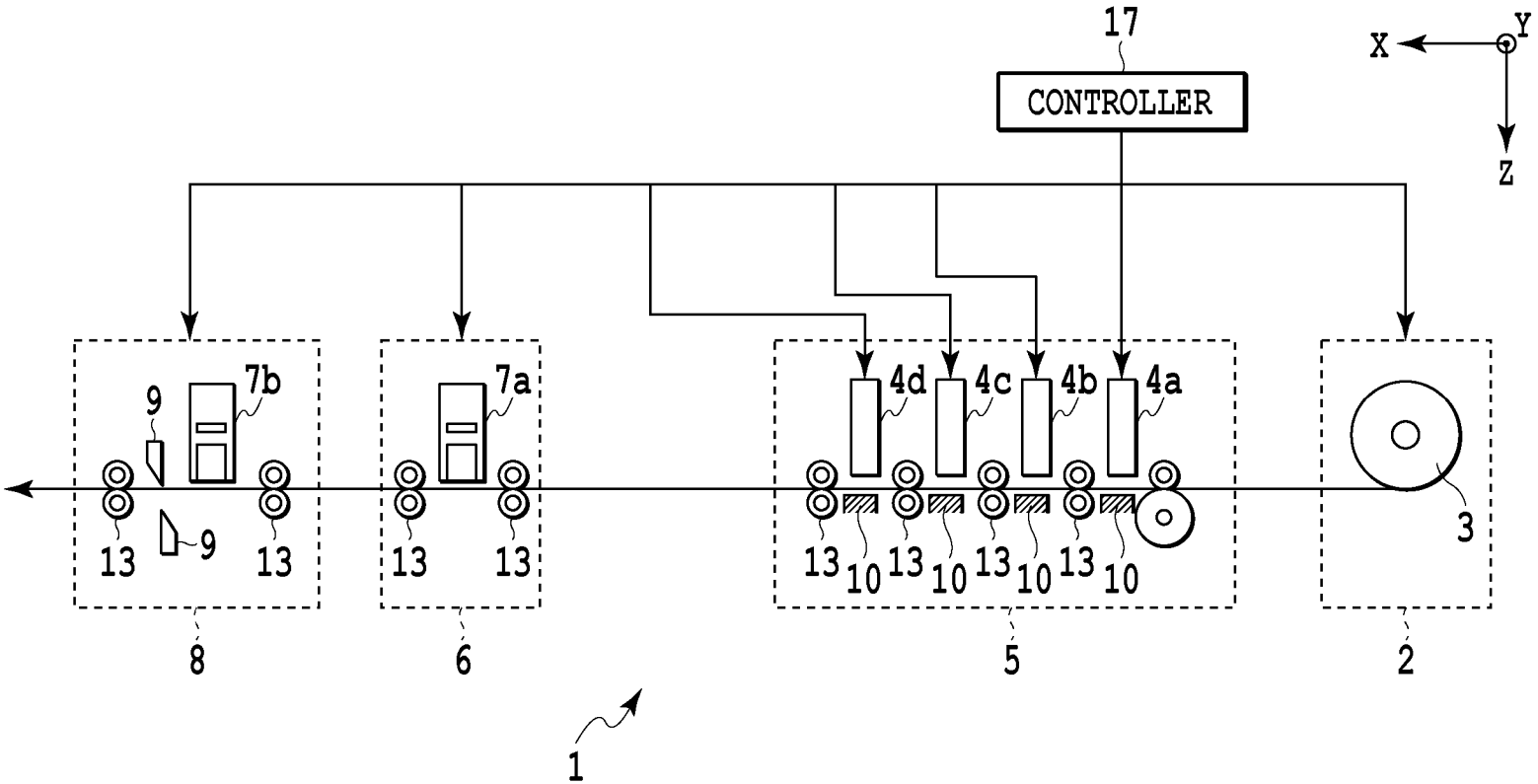
FIG. 2 is a cross-sectional view of the internal arrangement of the inkjet printing apparatus.

FIG. 2 is a cross-sectional view of the internal arrangement of the printing apparatus 1. As shown in FIG. 2, the printing apparatus 1 includes a feeding unit 2, the printing unit 5, an inspection unit 6 and a cutting unit 8. In this embodiment, the feeding unit 2 pulls the printing medium 3, which is stored as a rolled shape, and feeds the printing medium 3 into the printing unit 5, which is located downstream in the direction the printing medium 3 is conveyed.

The printing unit 5 then prints, on the printing medium 3 conveyed from the feeding unit 2, an image and a test pattern that is not related to the image forming process and is employed to examine the ejection states of those nozzles. The printing unit 5 also prints a cut mark pattern, which is employed as a guide mark for cutting the printing medium 3 into a predetermined size, and a flashing pattern and a nozzle test pattern that are employed to maintain the nozzle ejection state.

The printing unit 5 has full-line print heads 4*a* to 4*d* that eject differently colored inks, and for the individual print heads 4*a* to 4*d*, nozzle arrays are arranged in the widthwise direction (a direction Y) of the printing medium 3. In this embodiment, multiple nozzle arrays are arranged in the direction (the direction X) in which the printing medium 3 is to be conveyed. The individual nozzle arrays consist of a plurality of nozzles arranged in the direction Y at predetermined pitches, and when the printing medium 3 is conveyed at a specified speed in the direction that intersects the direction Y, ink from the plurality of nozzles is ejected onto the printing medium 3, forming ink dots thereon. In this embodiment, the print head 4*a* ejects black ink (K), the print head 4*b* ejects cyan ink (C), the print head 4*c* ejects magenta ink (M) and the print head 4*d* ejects yellow ink (Y). Furthermore, ink tanks in which individually colored inks are stored are connected to the corresponding print heads 4*a* to 4*d* by ink tubes, so that ink can be supplied to the print heads 4*a* to 4*b* in consonance with the consumption of ink. The print heads 4*a* to 4*d* will be described in more detail later.

A conveying mechanism 13 for conveying the printing medium 3 is also provided for the printing unit 5. The conveying mechanism 13 includes a plurality of roller pairs, each of which sandwich and support the printing medium 3. Platens 10 are arranged at the intervals between the roller pairs adjacent to each other, and each have a support face for holding the reverse side of the printing medium 3. The same conveying mechanism 13 is also provided for the inspection unit 6 and the cutting unit 8. The print heads 4*a* to 4*d*, the conveying mechanism 13 and the platens 10 are incorporated and stored in a single housing.

The inspection unit 6 includes a scanner 7*a* that reads an image and a test pattern printed by the printing unit 5. The obtained information is transmitted to a controller 17, which then examines, for example, the nozzle ejection states for the print heads 4*a* to 4*d*, the conveying state of the printing medium 3, and the printing position.

The scanner 7*a* includes a light emitting portion and an image pickup element (neither of them shown). The light emitting portion is located either at a position where light is to be reflected in the scanning direction of the scanner 7*a*, or at a position where light is to be emitted to the scanner 7*a* across the printing medium 3. In the former position case, the image pickup element receives the reflected light of light emitted by the light emitting portion, and in the latter position case, the image pickup element receives light that has been emitted by the light emitting portion and has passed through the printing medium 3. The image pickup element converts the received light into an electric signal, and outputs the electric signal. An example image pickup element can be a Charge Coupled Device (CCD) image sensor, or a Complementary Metal Oxide Semiconductor (CMOS) image sensor.

In this embodiment, the printing unit 5 prints a test pattern, not related to image forming, in the non-image area of the printing medium 3. The inspection unit 6 then reads and analyzes the detection pattern, and detects the ejection states of the printing elements that are provided for the print heads 4*a* to 4*d*.

The cutting unit 8 includes a scanner 7*b* having the same structure as the scanner 7*a*, and a pair of cutting mechanisms 9 that cut off the printing medium 3. The scanner 7*b* reads a cut mark pattern, printed on the printing medium 3 by the printing unit 5, and ascertains a cutting position, and the cutting mechanisms 9 sandwich and cut off the printing medium 3.

Thereafter, the cut portion of the printing medium 3 is conveyed to a drying unit (not shown) to dry the ink applied to the printing medium 3 portion. The drying unit employs a procedure whereby hot air is blown on the printing medium 3, or a procedure whereby the printing medium 3 is irradiated by an electromagnetic wave, such as an ultraviolet ray or an infrared ray, to dry the ink on the printing medium 3. The cut portion of the printing medium 3, after having been dried by the drying unit, is then discharged by a discharging unit.

When the conveying, printing, inspecting, cutting, drying and discharging procedures described above have been performed for the printing medium 3, the image bearing product can be obtained. The above described operations are performed when the controller 17 controls the feeding unit 2, the printing unit 5, the inspection unit 6, the cutting unit 8 and the conveying mechanisms 13.

Figure 3:
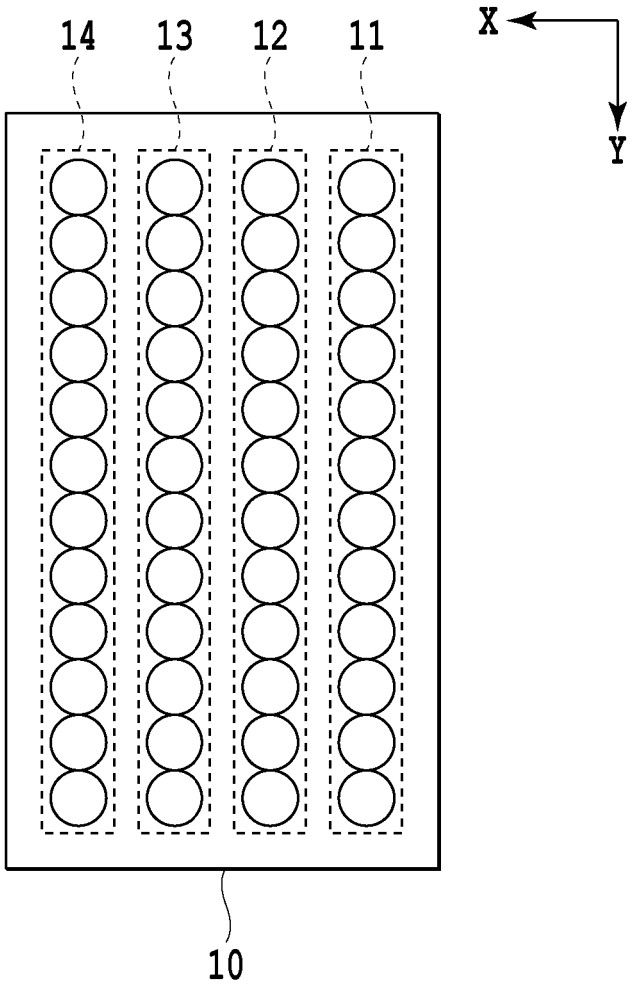
FIG. 3 is a diagram showing the nozzle arrangement of a print head.

FIG. 3 is a diagram showing the arrangement of the nozzles (ejection ports) for a chip 10 that is the constituent of the print head 4*a* of the four print heads 4*a* to 4*d*. In this embodiment, on the chip 10, four nozzle arrays 11 to 14 are aligned in parallel in the direction X, and for each of the nozzle arrays, a plurality of nozzles for ejecting the same type of ink are arranged at 600 dpi pitches in the direction Y. The individual nozzles are formed of an ejection energy generation element and an ejection port. The ink ejection method can, for example, be a method employing heating elements, a method employing piezoelectric elements, a method employing electrostatic elements, or a method employing Micro Electro Mechanical Systems (MEMS) elements. In this embodiment, since a plurality of the chips 10 are arranged in the direction Y, while being alternately shifted in the direction X, the print head 4*a* is provided that covers the width of the printing medium 3 in the direction Y with the nozzles that are arranged at pitches of 600 dpi.

With this structure, when the printing medium 3 is conveyed in the direction X, dots for one line extended in the direction X are printed by employing alternate rows of nozzles of the nozzle arrays 11 to 14, i.e., by employing a set of four nozzles. When an ejection failure for a specific nozzle is detected, complementary printing is performed by employing the other three nozzles.

It should be noted that a plurality of chips need not necessarily be employed to form a print head. A single chip for which nozzles are aligned in a line across the entire widthwise direction of the printing medium may also be employed to provide a print head. Furthermore, in this embodiment, the print heads 4*a* to 4*d* are employed in consonance with the four ink colors KCMY; note, however, that the number of ink colors and the number of print heads are not limited to four.

Figure 4:
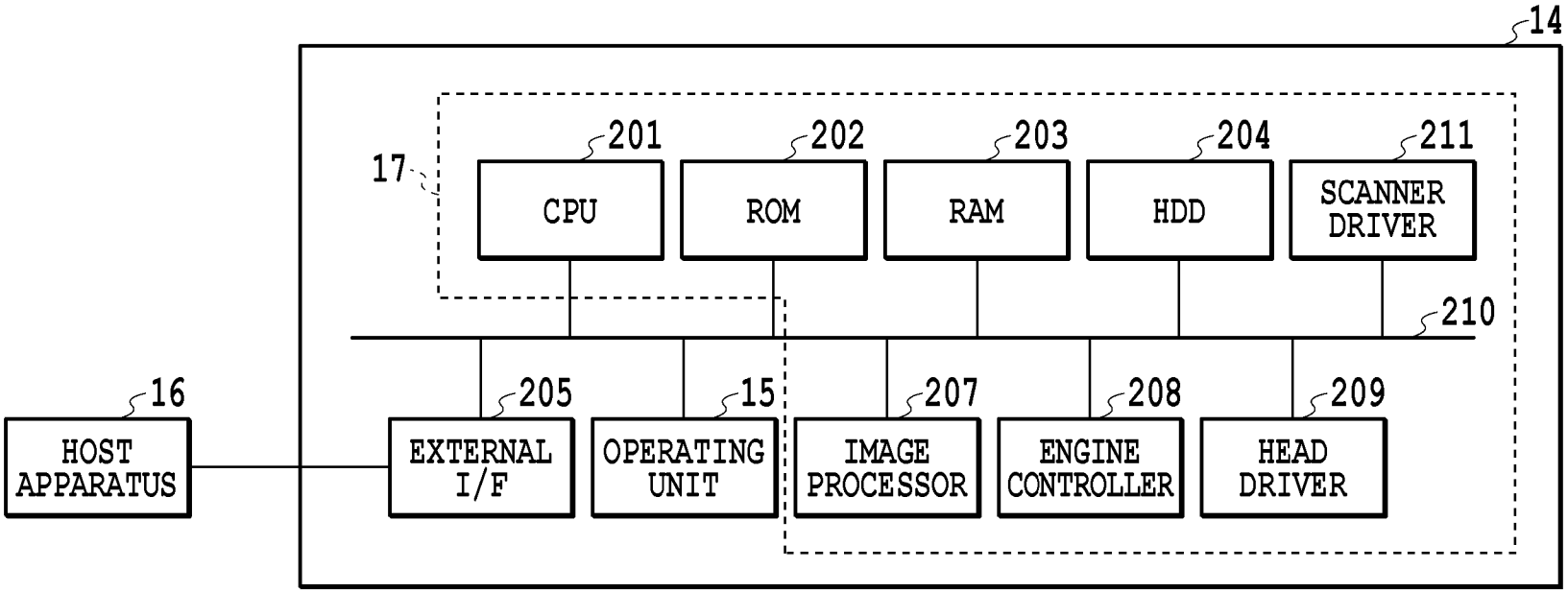
FIG. 4 is a block diagram illustrating the arrangement of the control section of the inkjet printing apparatus.

FIG. 4 is a block diagram illustrating the arrangement of a control unit 14 for the printing apparatus 1. The control unit 14 mainly includes: an external interface 205 that is used to exchange data with a host apparatus 16; the controller 17 that controls the entire printing apparatus 1; and the operating unit 15 that is employed as a user interface. The controller 17 includes a CPU 201, a ROM 202, a RAM 203, an HDD 204, an image processor 207, an engine controller 208, a head driver 209 and a scanner driver 211.

The CPU 201 employs the RAM 203 as a work area, and performs various processes in accordance with a program stored in the ROM 202. At this time, the HDD 204 is employed as a storage area for print data and setup information that the printing apparatus 1 requires to perform various operations. Under the control of the CPU 201, the image processor 207 performs the image processing for print data received from the host apparatus 16, and generates print data that the print heads 4*a* to 4*d* can employ for printing and stores the print data in the RAM 203 or the HDD 204. Based on the print data thus stored, the CPU 201 controls the head driver 209 that drive the print heads 4*a* to 4*d* to eject ink. At this time, the CPU 201 controls, through the engine controller 208, the feeding unit 2, the inspection unit 6, the cutting unit 8 and the conveying mechanisms 13. The CPU 201 also controls, via the scanner driver 211, the scanners 7*a* and 7*b*.

With respect to a user, the operating unit 15 is an input/output interface, and includes an input unit and an output unit. The input unit has hardware keys and a touch panel, with which the user can enter instructions for the printing apparatus 1, and the output unit can be either a display device for displaying data or an audio generator for audibly presenting data that is provided for the user.

The host apparatus 16 may be either a general-purpose apparatus, such as a computer, or a dedicated image apparatus, such as an image capture apparatus having an image reader, a digital camera or a photo storage device. When a computer is employed as the host apparatus 16, an operating system, application software and a printer driver for the printing apparatus 1 should be installed in the storage device of the computer.

(Characteristic Configuration)

The characteristic configuration for this embodiment will now be described. In the following description, in order to avoid confusion between data and a printed image, image data that is employed for printing in order to detect the ejection state of a nozzle is defined as test image data, and an image that is printed on a printing medium based on the test image data is defined as a test pattern. Further, data for an image, such as a photograph, that constitutes the printed object is defined as real image data, and an image that is printed on a printing medium based on the real image data is defined as a real image. In this embodiment, an explanation will be given for a case wherein, based on a single printing start command, a plurality of real images are to be sequentially printed on a printing medium, which is continuous paper.

Figure 5:
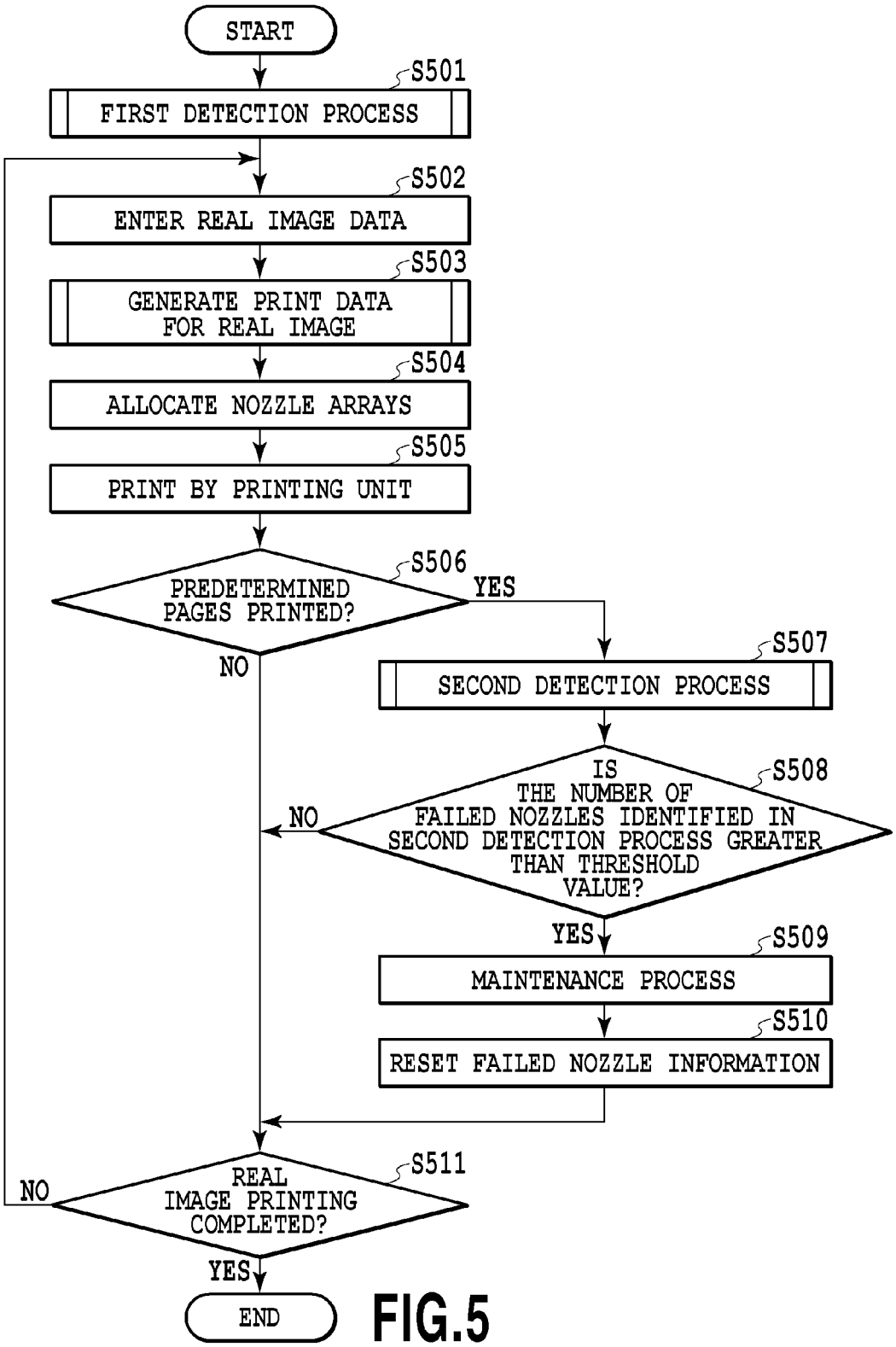
FIG. 5 is a flowchart showing the processing sequence performed in a case wherein a printing start command has been entered.

FIG. 5 is a flowchart showing the processing sequence performed by the CPU 201 in a case wherein the printing apparatus 1 receives a printing start command from the host apparatus 16, or from a user via the operating unit 15.

When this processing is begun, first at step S501, the CPU 201 performs a first detection process, and thereafter, receives real image data from the host apparatus 16 (step S502).

Figure 6:
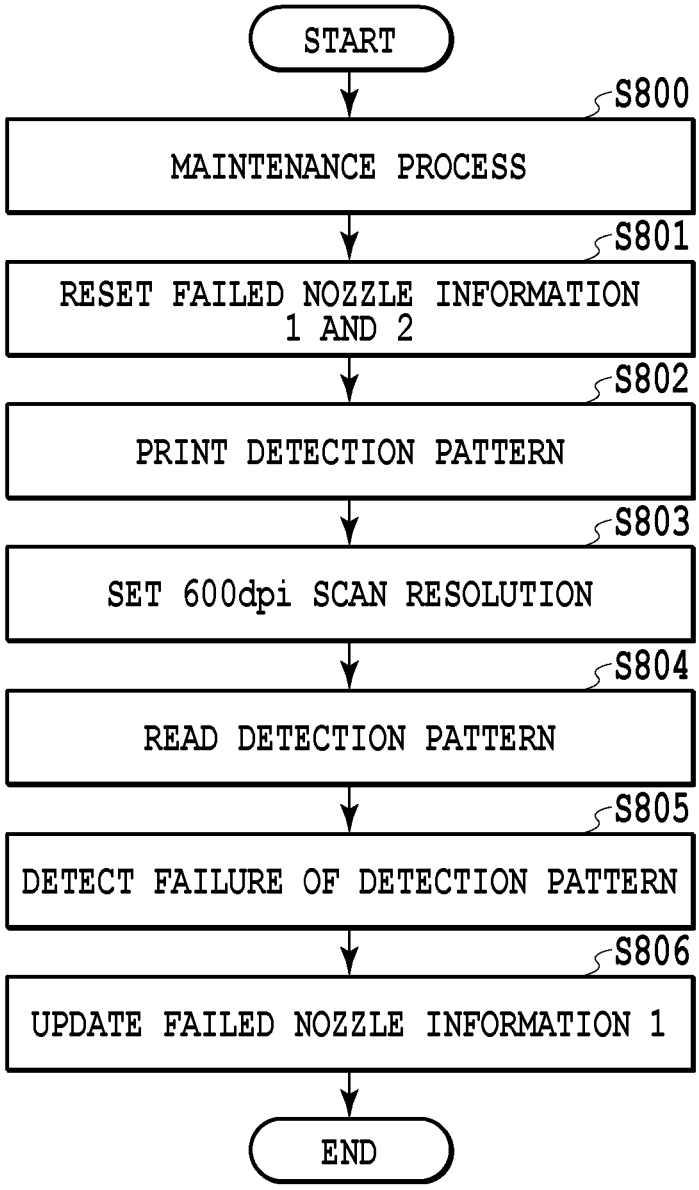
FIG. 6 is a flowchart for explaining a first detection processing sequence.

FIG. 6 is a flowchart for explaining the first detection process sequence performed at step S501. When this process is begun, first at step S800, the CPU 201 performs the maintenance process for the print heads 4*a* to 4*d*. This maintenance process is at least one of the following processes: a comparatively large-scale suction recovery process, a preliminary ejection process for ejecting ink to print an image and a wiping process for employing wipers to clean the ejection port faces of the print heads. When the maintenance process is performed, the ejection state can usually be normalized and can be recovered for nozzles other than those for which a semi-permanent failure, such as the breakdown of a heater, has occurred.

At step S801, the CPU 201 resets (clears) first detected failed nozzle information and second detected failed nozzle information stored in the HDD 204. In this embodiment, the first detected failed nozzle information and the second detected failed nozzle information are stored in different areas on the HDD 204, and at step S801, these two sets of information are reset. That is, data indicating that a pertinent nozzle is an ejection failed nozzle is changed to data indicating the pertinent nozzle is not an ejection failed nozzle, and a state is provided wherein there are no ejection failed nozzles present. It should be noted, however, that in a case wherein ejection failed nozzle information had already been obtained at the time of shipping, resetting of the first and second detected failed nozzle information may be performed to return to the information available at the time of shipping.

The first detected failed nozzle information is information indicating the result of the first detection process performed to determine whether the nozzle is an ejection failed nozzle or not, and with this information, the position of the print head and the position of the failed nozzle in the print head can be identified by the unit of one nozzle. Specifically, a nozzle that is identified as a failed nozzle during the first detection process is a nozzle for which the ejection state could not be recovered by performing the maintenance process at step S800, and probably can not, from then on, be recovered by performing another maintenance process. Therefore, when the maintenance process, which will be described later, is performed at step S509, at step S510, to update the ejection failed nozzle information, the first detected failed nozzle information is not reset, and is stored as ejection failed nozzle information. Furthermore, at step S504, which will be described later, to allocate image data to the individual nozzles, no image data are allocated to a nozzle that has been identified as being an ejection failed nozzle during the first detection process, and instead, are allocated to a different nozzle for the performance of complementary printing.

The second detected failed nozzle information is information indicating the results obtained during the second detection process at step S507, for determining whether a pertinent nozzle is a failed nozzle or not. As previously described, when an ejection failed nozzle is detected during the first detection process, at step S504, image data is so allocated that the remaining nozzles are employed to perform complementary printing. Whereas, a nozzle identified as an ejection failed nozzle in the second detection process is a nozzle whereat an ejection failure occurred during the printing of an image. The cause of this ejection nozzle failure will be described later in detail by employing FIGS. 14A and 14B. A failed nozzle that is detected during printing is regarded as a nozzle for which the ejection state can be recovered by performing the maintenance process. Therefore, when the maintenance process is performed at step S800 and S509, the second detected failed nozzle information is reset at step S801 and S510.

Next, at step S802, in accordance with test image data stored in the ROM 202 in advance, the CPU 201 employs the print heads 4*a* to 4*d* to print, on the printing medium 3, a test pattern for detecting an ejection failed nozzle. Thereafter, at step S803, the resolution employed for the reading unit 6 to read the test pattern is set to 600 dpi, which is equal to the print resolution, and at step S804, the scanner 7*a* is employed to read the test pattern.

Figure 7A:
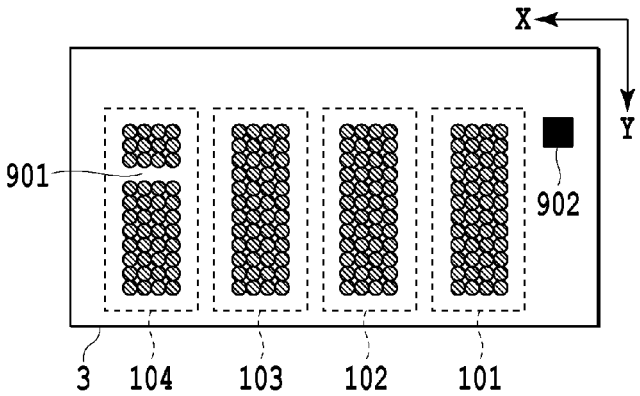
FIGS. 7A and 7B are diagrams showing the dot arrangement of a detection pattern for a first detection process, and the results obtained by reading.
Figure 7B:
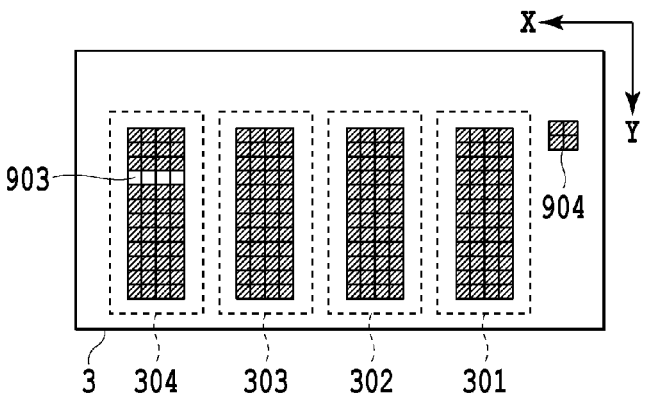

FIGS. 7A and 7B are diagrams showing the arrangement of dots in a detection pattern for the first detection process, and the results obtained by the inspection unit 6. While referring to FIG. 3, ink is sequentially ejected in the direction X, four dots each, from all of the nozzles included in a single nozzle array, and such a 4-dot continuous pattern is printed sequentially by the four nozzle arrays 11 to 14, thereby providing a test image in this embodiment. In FIG. 7A, a pattern 101 is printed by the nozzle array 11, a pattern 102 is printed by the nozzle array 12, a pattern 103 is printed by the nozzle array 13, and a pattern 104 is printed by the nozzle array 14. In this case, an ejection failure has occurred at the fourth nozzle of the nozzle array 14, and a portion to be printed by the pertinent nozzle appears as a white line 901. The print heads also print, as part of the test pattern, a reference pattern 902 that is employed to determine which nozzle of which nozzle array, to which the position where a white stripe is detected corresponds.

In FIG. 7B, image data 301 are the results obtained by scanning the pattern 101, image data 302 are the results obtained by scanning the pattern 102, image data 303 are the results obtained by scanning the pattern 103 and image data 304 are the results obtained by scanning the pattern 104. In this case, since the print resolution of the print heads 4*a* to 4*d* and the scan resolution of the scanner 7*a* are the same, 600 dpi, the individual pixels where dots are formed are detected as black (1), while only the fourth pixel of the image data 304 is detected as white (0).

At step S805, the CPU 201 determines the location of the ejection failed nozzle based on the position 903 where white data is identified and the position 904 where the reference pattern is detected, and stores the obtained information as the first detected failed nozzle information (step S806). While referring to the case shown in FIG. 7B, data indicating that the fourth nozzle of the nozzle array 14 is an ejection failed nozzle is stored in the area of the HDD 204 allocated for the first detected failed nozzle information.

The detection of an ejection failure has been described by employing the case wherein the pixels where dots are formed are identified as black (1) and the pixels where dots are not formed are identified as white (0); however, image data actually obtained by the scanner is multi-value luminance information, and whether dots are white or black is not easily determined. Therefore, at step S805, the ejection failed nozzle determination process may also be performed by calculating a moving average for scan luminance values in the direction X, and performing a histogram analysis in the direction Y.

The reason the first detected failed nozzle information and the second detected failed nozzle information are reset at step S801 is that, when a test pattern is to be printed at step S802, complementary printing of print data that is to be allocated to the failed nozzle should not be performed by employing the other nozzles. Therefore, so long as allocation of print data employed by a failed nozzle to the other nozzle can be avoided during printing of the test pattern, the resetting process at step S801 is not necessarily performed.

In this case, at step S801, the first detected failed nozzle information and the second detected failed nozzle information currently obtained are stored unchanged, instead of being reset. Following this, at step S802, print data is allocated to the failed nozzle, not to the normal nozzle, and printing of a test pattern is performed. Further, at step S806, the results obtained at step S804 are employed to update the first detected failed nozzle information, while the second detected failed nozzle information is reset. Through this process, the resetting process at step S801 can be eliminated, and the first detection process sequence can be shortened.

Figure 15:
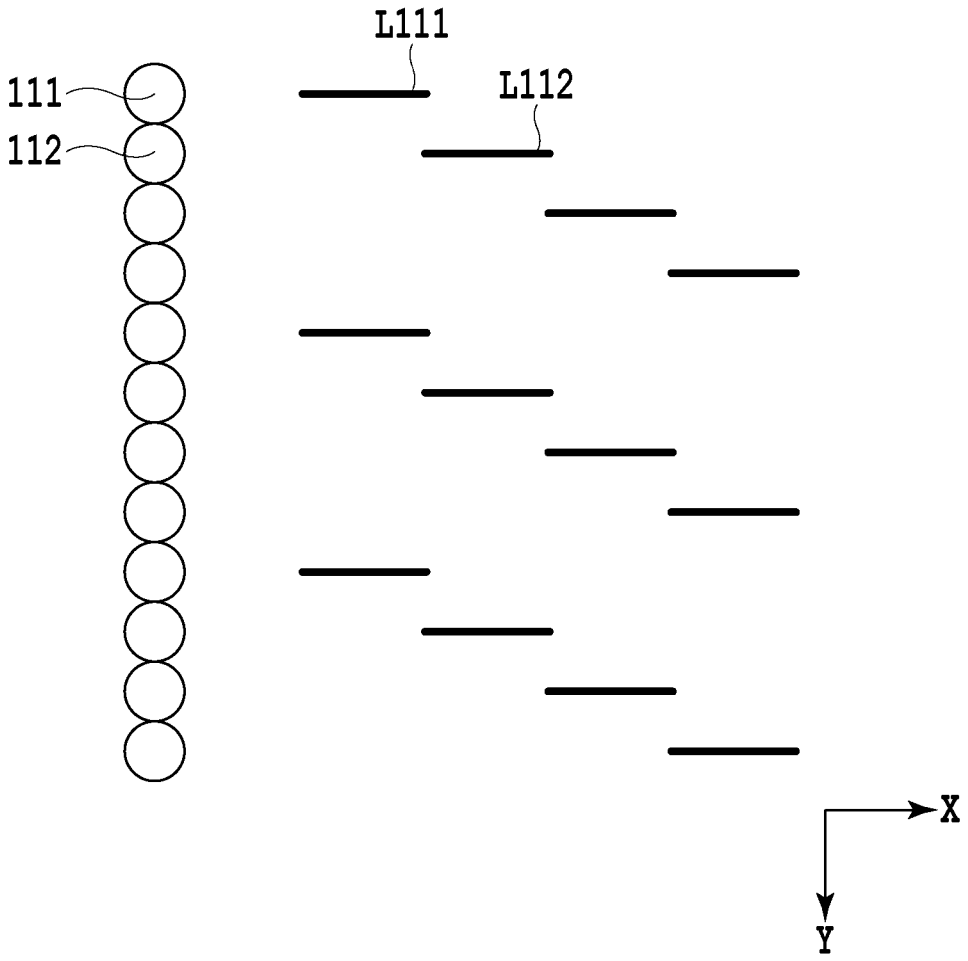
FIG. 15 is a diagram showing another example for a test pattern that can be employed for the first detection process.

The test pattern employed in the first detection process is not limited to the pattern shown in FIGS. 7A and 7B, and an arbitrary test pattern can be employed so long as ejection failed nozzles can be detected with the test pattern more accurately than with the test pattern employed in the second detection process. For example, with a test pattern shown in FIG. 15, the occurrence of an ejection failure can be detected for each nozzle. The test pattern in this case is a step-like pattern provided by the printing of a line L111 by a nozzle 111 and of a line L112 by a nozzle 112, while being offset from each other in the direction X. According to the test pattern shown in FIGS. 7A and 7B, in a case wherein ejected ink droplets have landed while being displaced in the direction Y, when the distance between the nozzles in the direction Y is small, erroneous detection of an ejection failure may occur, although an ink droplet was ejected via the pertinent nozzles. However, when the step-like pattern as shown in FIG. 15 is employed, erroneous detections of ejection failures can be reduced, and the accuracy of failed nozzle detection can be improved.

When the first detection process has been performed in the above described manner, the processing advances to step S502 in FIG. 5. Since the first detection process is a maintenance job, when this process has been completed, the portion of the printing medium 3 where the test pattern is printed is cut off, and the unused portion of the rolled paper is rewound.

At step S502, as the normal print job, the CPU 201 receives, from the host apparatus 16, real image data to be printed on the printing medium 3, and stores the real image data in the RAM 203. In this embodiment, the real image data received from the host apparatus 16 is RGB data of 300 dpi.

At step S503, the CPU 201 employs the image processor 207 to convert RGB multi-value data of 300 dpi for the real image into CMYK binary data of 600 dpi that can be printed by the print heads 4*a* to 4*d*.

Figure 8:
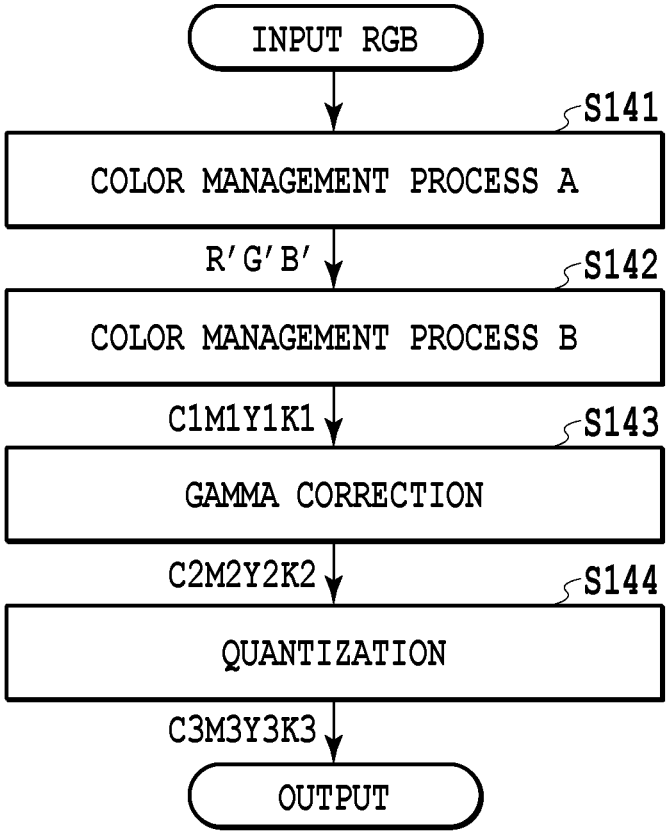
FIG. 8 is a flowchart for explaining the image processing performed by an image processor.

FIG. 8 is a flowchart for explaining the image processing performed for the real image data by the image processor 207. When this processing is begun, first at step S141, the image processor 207 performs a color management process A. The color management process A is a process for fitting a color space expressed by the host apparatus 16 to a color space that can be expressed by the printing apparatus 1, and RGB multi-value data of 300 dpi is converted into multi-value R'G'B' data of the same 300 dpi.

At the succeeding step S142, the image processor 207 performs a color management process B. The color management process B is a process for converting the RGB data, which is luminance data, into CMYK density data that is consonant with ink colors employed by the printing apparatus 1. Specifically, a three-dimensional lookup table stored in advance in the ROM 202 is examined to convert multi-value R'G'B' data into multi-value data C1, M1, Y1 and K1.

At step S143, a one-dimensional lookup table is employed to convert the multi-value data C1, M1, Y1 and K1 into multi-value data C2, M2, Y2 and K2. The γ correction process is performed in this case in order to establish a linear relationship of the densities that are actually expressed on the printing medium based on input density signals C1, M1, Y1 and K1.

At step S144, the quantization process is performed to convert the multi-value data C2, M2, Y2 and K2 of 300 dpi into binary data C3, M3, Y3 and K3 of 600 dpi that represent printing (1) or non-printing (0). A quantization method employed can be an error diffusion method or a dithering method. The binary print data obtained by quantization is stored in the RAM 203 for the individual rasters (rows continued in the direction X). When the image processing has been performed by the image processor 207 in this manner, print data C3, M3, Y3 and K3 that can be printed via the individual nozzles are obtained, and thereafter, the processing advances to step S504 in FIG. 5.

At step S504, the binary print data stored in the RAM 203 are allocated to the individual nozzles in accordance with the first detected failed nozzle information and the second detected failed nozzle information that are stored at step S806 in FIG. 6. In this case, as for a raster that does not include an ejection failed nozzle, print data (1) is allocated for all of the nozzle arrays 11 to 14. As for a raster that includes an ejection failed nozzle, print data is allocated only to those of the nozzle arrays 11 to 14 that perform normal ejection. In a case shown in FIG. 7B, print data (1) is allocated to only the nozzle arrays 11, 12 and 13, and is not allocated to the nozzle array 14.

At step S505, the CPU 201 permits the print heads 4*a* to 4*d* to perform printing for one page based on the print data that are allocated at step S504. At this time, since data to be printed by the nozzle, for which the ejection failure has been detected in the first detection process at step S501, is already allocated to other nozzles, an image without a white stripe can be output.

Following this, at step S506, the CPU 201 determines whether the printing unit 5 has completed the printing of a predetermined number of pages. When it is determined that a predetermined number of pages has not yet been printed, at step S511 the CPU 201 determines whether all of the real image data has been printed, and when printing of the real image data has not yet been completed, the processing returns to step S502 to perform the printing for the next page. Further, when all of the real image data has been printed, the processing is terminated. Furthermore, when it is determined at step S506 that a predetermined number of pages has been reached, the processing advances to step S507, and the second detection process is started.

Here, the predetermined number of pages is the number of pages that define the interval lasting until the second detection process begins, and is preferably the number of pages that does not cause sudden multiple occurrences of ejection failures. The number of pages can be appropriately set in accordance with the printing conditions, and can also be designated by a user. The interval at which a test pattern is to be inserted for the second detection process need not be determined based on the number of pages for printing images (the number of cut sheets). For example, the test pattern may be inserted at the time where the length of the printing medium in the conveying direction exceeds a predetermined length, or at the time wherein a predetermined period of time has elapsed.

Figure 9:
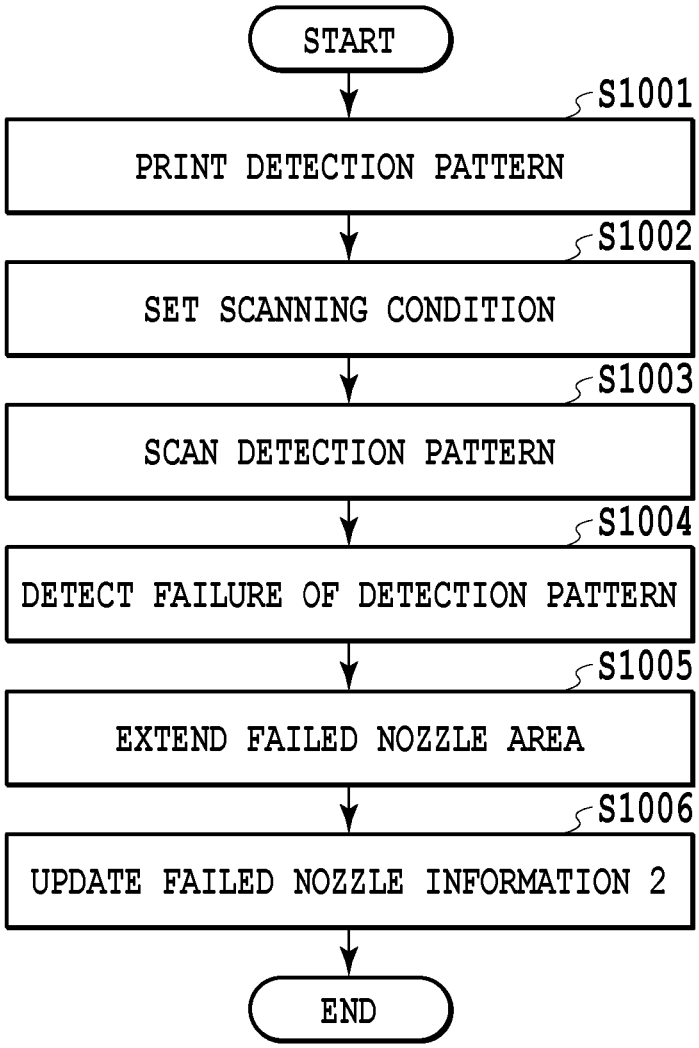
FIG. 9 is a flowchart for explaining a second detection processing sequence.

FIG. 9 is a flowchart for explaining the second detection process sequence performed at step S507. When this process is begun, first, at step S1001, the CPU 201 employs the test image data as well as those for the first detection process, and prints a test pattern for detecting an ejection failed nozzle. Since the second detection process performed during sequential printing should be completed within a short period of time, the printing of the test pattern is initiated immediately, without performing the print head maintenance process.

Figure 10A:
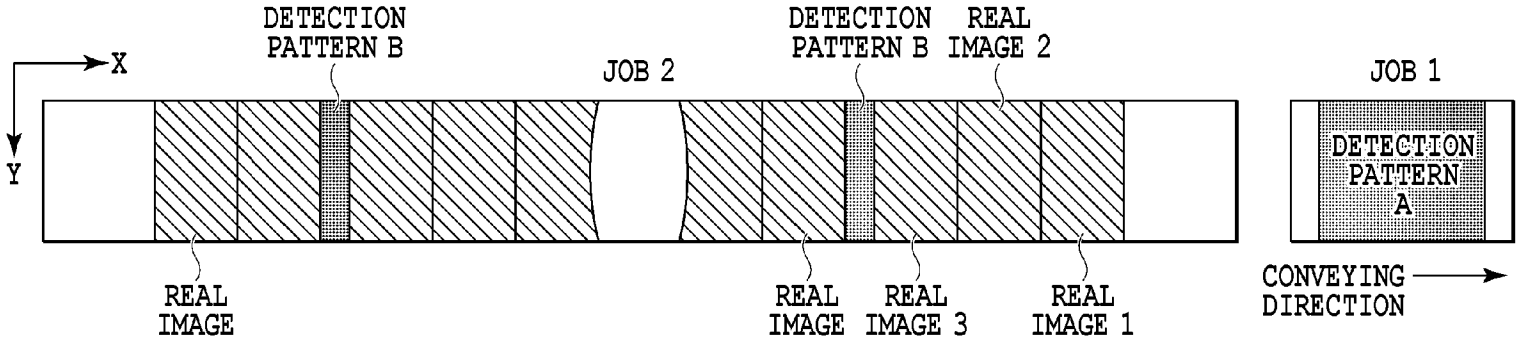
FIGS. 10A and 10B are diagrams showing the states in which a real image and a test pattern are sequentially printed on a printing medium.
Figure 10B:
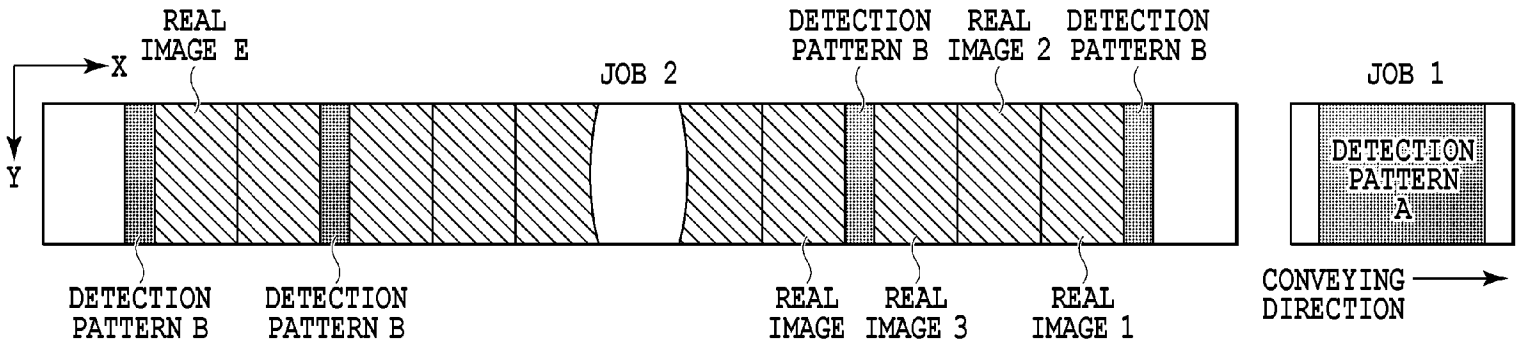

FIG. 10A is a diagram showing the state wherein real images and detection patterns are sequentially printed on the printing medium 3, which is continuous paper. In FIG. 10A, a detection pattern A is a detection pattern printed during the first detection process, and a detection pattern B is a detection pattern printed during the second detection process. Real images 1, 2 and 3 are those printed by repeating the processes at steps S502 and S503 three times for the real image data. When the detection pattern B has been printed, the next real image data is sequentially printed without delay. In this embodiment, the detection pattern for the second detection process is printed between real images without wasting time and space. Further, when as shown in FIG. 10B the detection pattern B is inserted before a real image 1 and after a real image E and the second detection process is performed, the state without an ejection failure can be maintained at the time of the starting and the ending of image printing.

Referring again to the flowchart in FIG. 9, when the detection pattern is printed at step S1001, the CPU 201 advances to step S1002 to set the scan resolution for the detection pattern to 300 dpi. The resolution of 300 dpi is half of the 600 dpi that is employed as the print resolution or the scan resolution in the first detection process. Thereafter, the CPU 201 advances to step S1003, and employs the scanner 7*a* to read the test pattern. The speed at which the printing medium 3 is conveyed for the scanning of the detection pattern at step S1003 is higher than the speed at which the printing medium 3 is conveyed for scanning the test pattern in the first detection process at step S804. That is, since the second detection process is to be performed during the sequential printing of real images, the processing speed is higher than that for the first detection process that is performed at a time other than not during sequential printing.

Figure 11A:
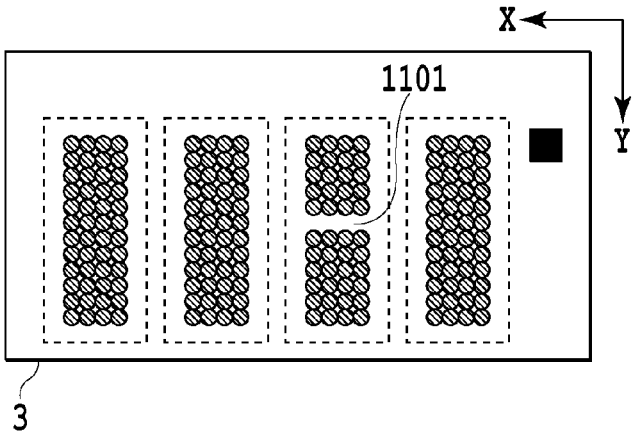
FIGS. 11A and 11B are diagrams showing the dot arrangement of a detection pattern for a second detection process and the results obtained by reading.
Figure 11B:
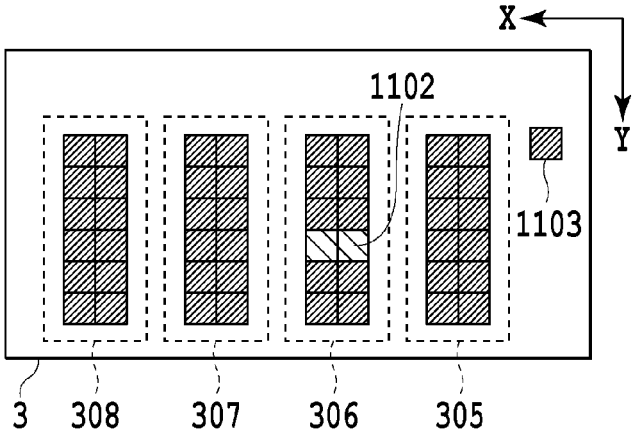

FIGS. 11A and 11B are diagrams showing the arrangement of dots in a test pattern during the second detection process, and the results obtained by the inspection unit 6. As well as the test pattern printed during the first detection process, the test pattern printed during the second detection process is provided by printing a 4-dot continuous pattern by using the four nozzle arrays 11 to 14 rotationally.

In this case, the four dots that are supposed to be printed by the fourth nozzle of the nozzle array 14, which has been determined to be an ejection failed nozzle during the first detection process, are printed by the fourth nozzles of the nozzle arrays 11, 12 and 13. Thus, a white stripe 901 shown in FIG. 7A does not appear. However, in the second test pattern printed after the real image data had been printed for three pages, an ejection failure occurred at the sixth nozzle of the nozzle array 12, and a white stripe 1101 appeared at the location where the dots should be printed by the pertinent nozzle.

Figure 12A:
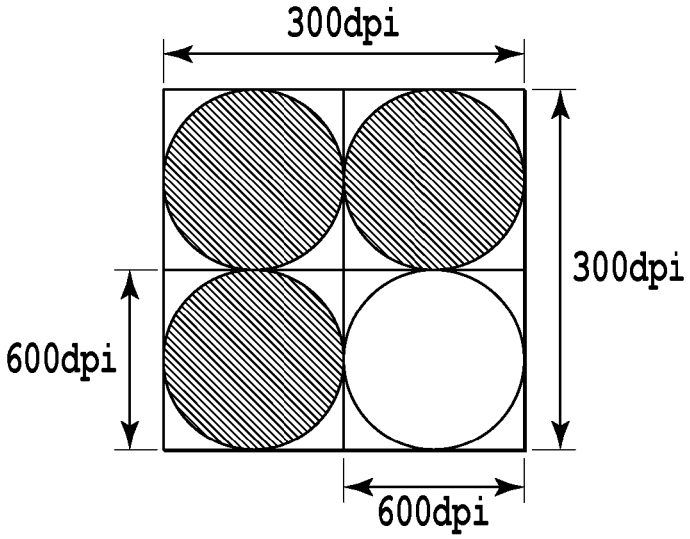
FIGS. 12A to 12C are diagrams showing relationships between the print resolution and the scan resolution during the second detection processing.
Figure 12B:
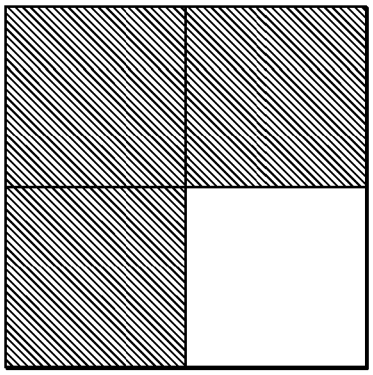
Figure 12C:
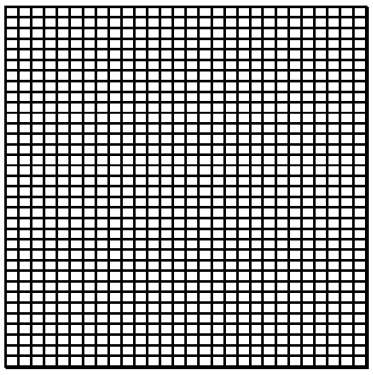

FIGS. 12A to 12C are diagrams showing the relationship between the print resolution and the scan resolution. Since the print resolution of the print head is 600 dpi and the scan resolution of the scanner is half of the print resolution, i.e., 300 dpi, the area of one pixel of the scan resolution corresponds to an area of 2 pixels×2 pixels for the print resolution.

At this time, assume that, as shown in FIG. 12C, dots are printed in three pixels in the area of 2 pixels×2 pixels of 600 dpi, and no dot is printed in one pixel. In this case, when the thus printed image is scanned at the resolution of 600 dpi, the data as shown in FIG. 12B is obtained. That is, the scan value of a pixel wherein a dot is printed is black (1), while the scan value of a pixel whereat a dot is not printed is white (0), and the same results are obtained as an actual printed fact.

On the other hand, when an image printed as shown in FIG. 12A is scanned at the resolution of 300 dpi, data shown in FIG. 12C is obtained. That is, since scanning is performed to obtain the density of the entire area where four dots can be printed and three dots are actually printed, the result indicating the average of the presence/absence of a dot is obtained. Specifically, the fact that an area where a dot is not printed is included in the one-pixel area of 300 dpi is obtained, but the location at which a dot is not printed cannot be identified.

When the above described processing is performed, the result shown in FIG. 11B is obtained by scanning the detection pattern shown in FIG. 11A. It can be ascertained that the white stripe 1101 is included at a position 1102 where a low density is detected.

Thereafter, at step S1004, the CPU 201 determines the location of an ejection failed nozzle based on the position 1102, whereat a pixel having a low density has been detected, and a position 1103 whereat a reference pattern is detected. In the case shown in FIG. 11B, it is determined that the area where the white stripe 1101 has appeared is included in the area 1102 where a low-density pixel is detected, i.e., it is determined that an ejection failure has occurred at either or both of the fifth and sixth nozzles of the nozzle array 12.

It should be noted, however, that the 2×2 pixel area of 600 dpi, defined by the dot printing positions, and the 1 pixel area of 300 dpi, read by the scanner, do not always match each other, with respect to the surface of paper. Therefore, in this embodiment, at the succeeding step S1005, a range designated for an ejection failed nozzle is extended around two nozzles detected at step S1004. Specifically, the third to the eighth nozzles of the nozzle array 12 are regarded as ejection failed nozzles (see FIG. 11B). Since this range extension process is performed, the occurrence of such a phenomenon can be avoided that printing by a nozzle whereat the ejection failure has actually occurred is not identified as an ejection failure, and complementary printing for the nozzle can not be performed by employing the other nozzles.

Thereafter, the processing advances to step S1006, and information indicating that the third to the eighth nozzles of the nozzle array 12 are ejection failed nozzles is stored in the area of the HDD 204 for the second detected nozzle failure information.

However, in a case wherein it is known in advance that almost no deviation will occur between the 2×2 pixel area of 600 dpi and the 1 pixel area of 300 dpi detected by the scanner, the process at step S1005 is not always required. In such a case, the processing is moved from step S1004 to step S1006, and information indicating that the fifth and the sixth nozzles of the nozzle array 12 may be stored in the area of the HDD 204 for the second detected failed nozzle information. Thereafter the second detection process is terminated, and the processing advances from step S507 to S508 in FIG. 5.

As described above, the accuracy for detecting an ejection failed nozzle in the above described second detection process is lower than that in the first detection process. Further, since the occurrence of an ejection failure is examined for each nozzle group, not for each nozzle, there is a possibility that a nozzle that is not actually an ejection failed nozzle will be determined to be an ejection failure, and a real image that will not be printed by using such normal nozzle. However, the resolution employed for the second detection process is reduced to half, and accordingly, the number of pixels to be targeted for the image processing is reduced, so that the processing can be performed at a high speed, and can be quickly shifted to the printing of the next real image.

At step S508, a check is performed to determine whether a predetermined number or more of nozzles are identified as ejection failed in the second detection process. When the number of nozzles identified as an ejection failure does not exceed a predetermined count, the processing is moved to step S511, or when the number of ejection failed nozzles exceeds the predetermined count, it is ascertained that the performance of the complement process for the ejection failed nozzles reaches the limit, and the processing advances to step S509.

Figure 13A:
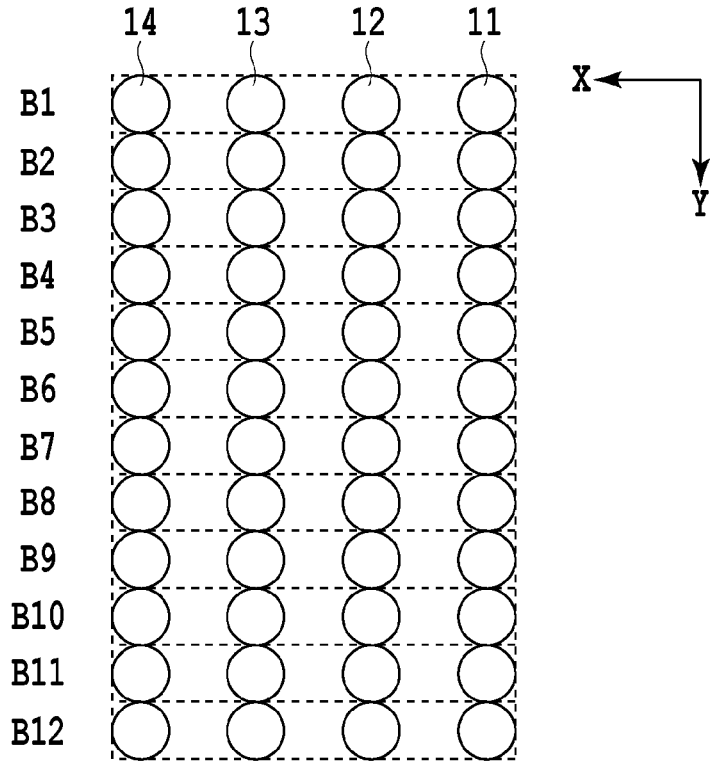
FIGS. 13A and 13B are diagrams for explaining a method for counting ejection failed nozzles.
Figure 13B:
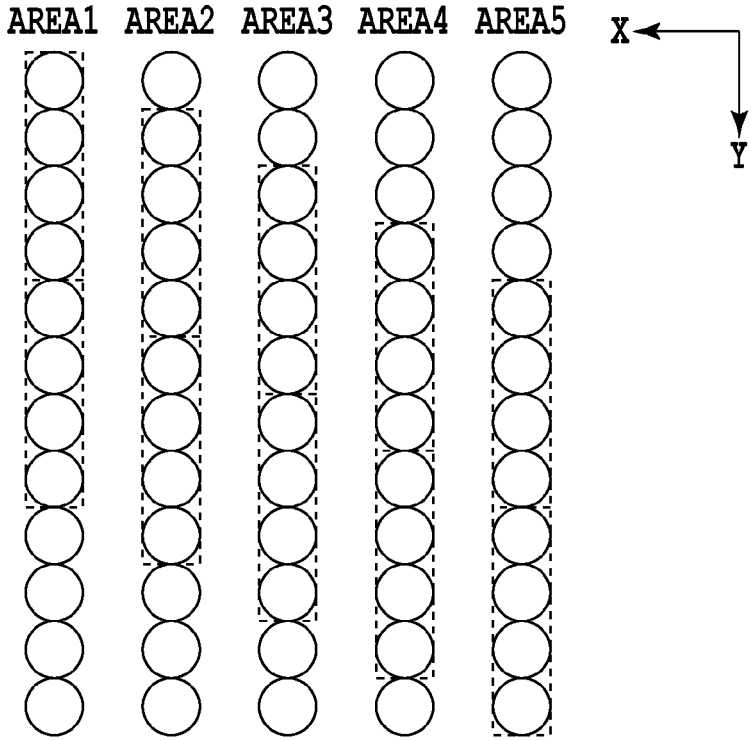

FIGS. 13A and 13B are diagrams for explaining the method for counting nozzles identified as ejection failures. The process at step S508 is a process for "determining whether there are enough normal nozzles to perform the complement process for print data of the ejection failed nozzle". Therefore, the determination process varies depending on which nozzles are employed for the complement process for print data allocated to the ejection failed nozzle.

FIG. 13A is a diagram showing a case wherein, as well as in the embodiment, the printing position of the ejection failed nozzle is complementary with a nozzle of another nozzle array that prints the same raster data. In this case, of the four nozzles used to print the same raster data, ejection failed nozzles are counted. This counting process is performed for all of the raster data, and in a case wherein there is even one raster, for which the count value is equal to or greater than a threshold value (for example, 3), it is ascertained that the ejection complement process is disabled, and the processing moves to step S509.

FIG. 13B is a diagram showing a counting method for a case wherein the printing position for an ejection failed nozzle is complementary with the adjacent nozzles of the same nozzle array. In this case, ejection failed nozzles included in an area consisting of eight continuous nozzles are counted by shifting the area, one nozzle at a time. In a case wherein there is even one area, for which the count value is equal to or greater than a threshold value (for example, 7), it is ascertained that the ejection complement process is disabled, and the processing advances to step S509.

At step S509, the maintenance process for the print heads is performed. This maintenance process is the same as the maintenance process sequence performed at step S800 in the first detection process, and an ejection failure other than the one due to a semi-permanent cause, i.e., an ejection failure detected in the second detection process, can be substantially corrected for.

Figure 14A:
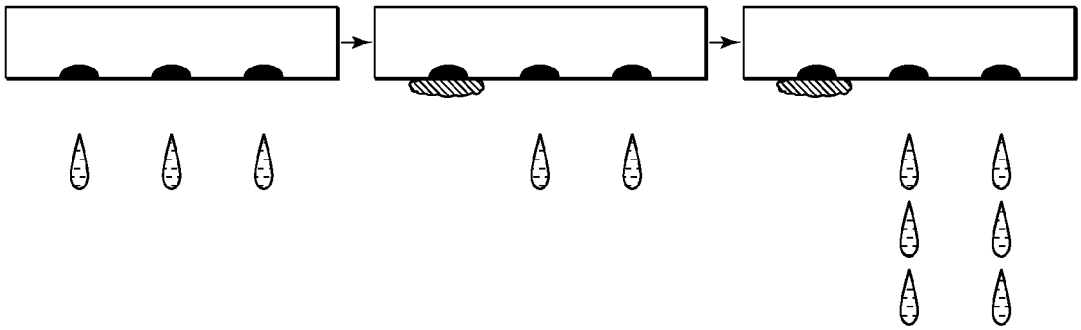
FIGS. 14A and 14B are diagrams showing the states of ejection failed nozzles.
Figure 14B:
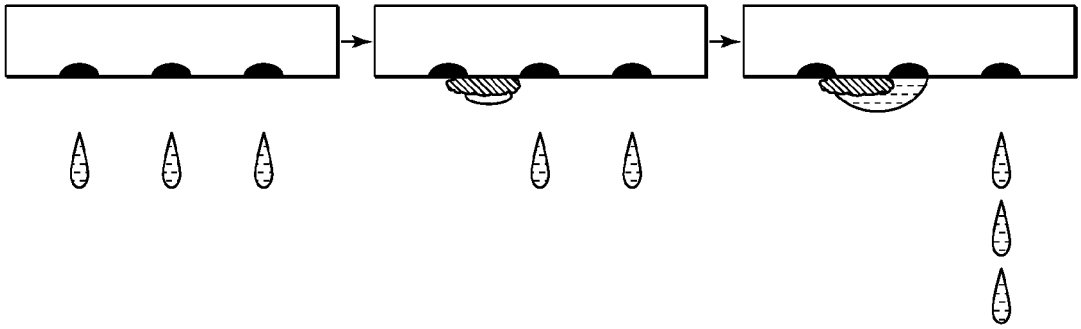

FIGS. 14A and 14B are diagrams for explaining the states of the ejection of failed nozzles that are newly detected in the second detection process. An ejection failure that is newly detected during the second detection process is an ejection failure that has occurred due to sequential printing that is not accompanied by the maintenance process, and that is caused mainly by a bit of paper that has entered from the surface of the ejection port, or by a bubble formed inside the nozzle. For example, FIG. 14A is a diagram showing a case wherein, during a normal ejection, an ejection port has become blocked with a foreign substance, such as a bit of paper, and is completely closed. In this case, even when the ejection operation is continued, ink is not being ejected from the blocked nozzle. Whereas, FIG. 14B is a diagram showing a case wherein, during the normal ejection, an ejection port is partially blocked with a foreign substance, such as a bit of paper, and is half closed. In this case, when the ejection operation is continued, ink that has seeped through the half-closed ejection port is coagulated around the foreign substance, and the coagulated ink is gradually increased to block the ejection port of the adjacent nozzle.

Furthermore, when printing of the real image is continued without performing the maintenance process, the number of ejection failed nozzles shown in FIG. 14A or FIG. 14B is gradually increased. It should be noted, however, that when a series of the maintenance processes, such as the suction recovery process, the wiping process for the ejection port face and the preliminary ejection process, are performed, the foreign substance and coagulated ink are comparatively easily removed. That is, the ejection failed nozzle newly detected in the second detection process can be substantially recovered to the original state so long as the maintenance process at step S509 is performed periodically.

The processing thereafter advances to step S510, at which the CPU 201 resets the second detected failed nozzle information stored in the HDD 204, and the processing advances to step S511. At this time, the first detection information is not reset, and is maintained as the ejection failed nozzle information.

At step S511, a check is performed to determine whether printing for all of the real images has been completed, and when printing is not yet completed, the processing is returned to step S502 to perform printing for the next page. When printing is completed, the processing is terminated.

As described above, according to the present invention, the first detection process for detecting an ejection failed nozzle with a high accuracy, and the second detection process for detecting an ejection failed nozzle with a low accuracy but at a high speed, are prepared. In a case wherein sequential printing is not currently performed, the first detection process is performed with being accompanied by the maintenance process, and in a case wherein sequential printing is currently performed, the second detection process is performed at a predetermined timing without being accompanied by the maintenance process. However, in a case wherein the number of ejection failed nozzles detected in the second detection process has reached a predetermined count or greater, the maintenance process is performed to reset only the information about the ejection failed nozzles that were detected in the second detection process.

According to this embodiment, even when sequential printing is being performed, the printing operation need not be interrupted by the maintenance process, and an ejection failed nozzle can be rapidly detected to perform complementary printing. Further, while the minimum required maintenance process is performed at an appropriate timing, information can be maintained as for an ejection failed nozzle that can not be recovered by the maintenance process, and complementary printing relative to the printing position of the ejection failed nozzle can be continued.

In the above described embodiment, 600 dpi is employed as the print resolution, 600 dpi is employed as the first scan resolution for the first detection process, and 300 dpi is employed as the second scan resolution for the second detection process. However, the resolutions employed for the present invention are not limited to those. For example, the first scan resolution may be set higher than the print resolution. In this case, the detection accuracy for the first detection process can be higher than that for the embodiment. Furthermore, the second scan resolution may not be half of the print resolution, and may be equal to the print resolution, so long as the process load imposed is not so great that the high-speed processing will not be adversely affected. Whereas, in a case wherein a great processing load is imposed although the second scan resolution is about half of the print resolution, the second scan resolution may be set much lower. Furthermore, since the resolution in the nozzle arrangement direction, i.e., the resolution in the direction Y influences the detection of the position of an ejection failed nozzle, the resolution in the printing medium conveying direction (the direction X) is not especially designated.

Moreover, according to the above description, the first detection process is initiated at the time where the printing apparatus has received a print command, i.e., immediately before the printing operation is started. However, the timing for starting the first detection process is not limited to this time. So long as the printing operation is not interrupted, the first detection process may be performed at an arbitrary time, such as when the power of the printing apparatus is turned on. For example, the first detection process may be performed at the time designated by a user through the operating unit 15.

Further, in this embodiment, at step S506, the time for performing the second detection process is determined depending on whether the printing unit 5 has printed a predetermined number of pages. However, the present invention is not limited to this process form. It is only required for step S506 to determine whether the printing operation has been continued to a degree at which an ejection failure could occur, and a determination reference other than the number of pages may also be employed. In a case wherein real images of various sizes are to be sequentially printed, determination may be performed while taking into account the sizes of the real images, as well as the number of pages, and further, a period of time where the printing operation was continued, the elapse time since the previous maintenance process was performed, the conveying distance and the value indicating the ejection frequency may also be employed as determination references.

Further, in this embodiment, the same test image data has been employed for the first detection process and the second detection process; however, it is also effective that different test images are employed to print different detection patterns between the first detection process for which the accuracy is important and the second inspection process sequence for which the processing time is important.

Moreover, in this embodiment, complementary printing for an ejection failed nozzle has been performed by employing the other three nozzles, which were assigned together with the ejection failed nozzle to print the same raster. The ejection complement method is not limited to this. As explained while referring to FIG. 13B, the nozzles that belong to the same nozzle array as the ejection failed nozzle and that are positioned on both sides of the ejection failed nozzle in the direction Y may be employed to complement (supplement) the printing position of the ejection failed nozzle.

Furthermore, the full-line head inkjet printing apparatus that prints images on continuous paper has been employed as an example; however, the present invention is not limited to this type of printing apparatus. The present invention can be effective for a case wherein real images are to be sequentially printed, at a high speed, on a plurality of cut sheets, or in a case wherein a serial type print head is employed. Further, when a serial type printing apparatus is employed, multipass printing can be performed, and in this case, an ejection complement method can also be employed whereby normal nozzles can be employed to perform printing, through a specific scan, at a position whereat printing is supposed to be performed using an ejection failed nozzle through a different scan.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-150636, filed Jul. 4, 2012, which is hereby incorporated by reference herein in its entirety.

What is claimed is:

1. An inkjet printing apparatus, which employs a print head wherein a plurality of nozzles for ejecting ink are arranged in a predetermined direction, and sequentially prints a plurality of images on a printing medium that is conveyed in a direction that intersects the predetermined direction, comprising:

a maintenance unit configured to perform maintenance for the print head;

a determination unit configured to perform a first determination, in which whether a nozzle is an ejection failed nozzle or not is determined based on a result obtained by scanning a first detection pattern during a period other than a sequential printing operation, and a second determination, in which whether a nozzle is an ejection failed nozzle or not is determined based on a result obtained by scanning a second detection pattern during the sequential printing operation;

a storage unit configured to store first information, which corresponds to results obtained by the first determination, and second information that corresponds to results obtained by the second determination;

a printing unit configured to employ a nozzle wherein an ejection failure has not occurred, and not employ an ejection failed nozzle, based on the first information and the second information, and perform the sequential printing, of the plurality of images on the printing medium; and a changing unit configured to maintain, in a case wherein the first determination is not performed after the maintenance by the maintenance unit has been performed, the first information unchanged, and change the second information from information indicating an ejection failed nozzle to information indicating a nozzle whereat an ejection failure has not occurred.

2. The inkjet printing apparatus according to claim 1, wherein in a case wherein the first determination is performed after the maintenance by the maintenance unit has been performed, the changing unit changes the first information based on the results obtained by the first determination, and changes the second information from information indicating an ejection failed nozzle to information indicating a nozzle whereat an ejection failure has not occurred.

3. The inkjet printing apparatus according to claim 1, wherein an image for the first detection pattern and an image for the second detection pattern differ from each other.

4. The inkjet printing apparatus according to claim 1, further comprising:

an inspection unit configured to detect the first detection pattern and the second detection pattern.

5. The inkjet printing apparatus according to claim 4, wherein a speed at which the printing medium on which the first detection pattern is printed is conveyed when the inspection unit scans the first test pattern is lower than a speed at which the printing medium on which the second detection pattern is printed is conveyed when the inspection unit scans the second test pattern.

6. The inkjet printing apparatus according to claim 1, wherein the first determination is performed for each nozzle, and the second determination is performed for each set of a plurality of nozzles.

7. The inkjet printing apparatus according to claim 6, wherein the first determination is a determination based on the results obtained by scanning the first detection pattern at a first resolution, and the second determination is a determination based on the results obtained by scanning the second test pattern at a second resolution that is lower than the first resolution.

8. The inkjet printing apparatus according to claim 7, wherein the first resolution is equal to or greater than a print resolution of the print head.

9. The inkjet printing apparatus according to claim 1, wherein before the determination unit performs the first determination, the changing unit changes the first information and the second information, which are stored in the storage unit, from information indicating an ejection failed nozzle to information indicating a nozzle whereat an ejection failure has not occurred.

10. The inkjet printing apparatus according to claim 1, wherein the print head includes a plurality of nozzles, from which ink of the same color is to be ejected for pixels at the same positions on the printing medium and which are arranged in consonance with the conveying direction; and wherein, for sequential printing of the plurality of images, the printing unit allocates print data of the ejection failed nozzle to another nozzle which is not an ejection failure nozzle and can eject ink to the same pixel as the ejection failed nozzle.

11. The inkjet printing apparatus according to claim 1, wherein the determination unit performs the first determination in a case wherein a command for instructing the sequential printing is received.

12. The inkjet printing apparatus according to claim 1, wherein the maintenance process includes at least one of a suction recovery process for the print head, a preliminary ejection process for ejecting, from the print head, ink that does not contribute to printing, and a wiping process for wiping an ejection port face of the print head.

13. The inkjet printing apparatus according to claim 1, wherein the print head is provided by arranging a number of nozzles that correspond to the width of the printing medium;

wherein the printing medium is continuous paper that is to be conveyed at a constant speed in the conveying direction during the sequential printing; and wherein the second detection pattern is to be printed in areas between the plurality of images.

14. An inkjet printing method, for employing a print head wherein a plurality of nozzles for ejecting ink are arranged in a predetermined direction, and sequentially printing a plurality of images on a printing medium that is conveyed in a direction that intersects the predetermined direction, comprising:

a maintenance step of performing maintenance for the print head;

a determination step of performing a first determination, in which whether a nozzle is an ejection failed nozzle or not is determined based on a result obtained by scanning a first detection pattern during a period other than a sequential printing operation, and a second determination, in which whether a nozzle is an ejection failed nozzle or not is determined based on a result obtained by scanning a second detection pattern during the sequential printing operation;

a storage step of storing first information, which corresponds to results obtained by the first determination, and second information that corresponds to results obtained by the second determination;

a printing step of employing a nozzle wherein an ejection failure has not occurred, and not employing an ejection failed nozzle, based on the first information and the second information, and performing the sequential printing, of the plurality of images on the printing medium; and a changing step of maintaining, in a case wherein the first determination is not performed after the maintenance by the maintenance unit has been performed, the first information, unchanged, and changing the second information from information indicating an ejection failed nozzle to information indicating a nozzle whereat an ejection failure has not occurred.

* * * * *